US009743201B1

(12) United States Patent
Lindahl et al.

(10) Patent No.: US 9,743,201 B1
(45) Date of Patent: Aug. 22, 2017

(54) LOUDSPEAKER ARRAY PROTECTION MANAGEMENT

(71) Applicant: Apple Inc., Cupertino, CA (US)

(72) Inventors: Aram M. Lindahl, Menlo Park, CA (US); Douglas J. Button, Simi Valley, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 14/210,100

(22) Filed: Mar. 13, 2014

Related U.S. Application Data

(60) Provisional application No. 61/784,944, filed on Mar. 14, 2013.

(51) Int. Cl.
*H04R 29/00* (2006.01)

(52) U.S. Cl.
CPC ..... *H04R 29/002* (2013.01)

(58) Field of Classification Search
CPC .. H04R 3/04; H04R 2430/00; H04R 2430/03; H03H 17/0261; H03H 17/0283; H03H 17/0294; H03H 17/0621
USPC ..... 340/691.3; 341/53; 370/389; 381/17, 381/55, 59, 61, 71.1, 89, 103, 119, 304, 381/345, 186, 303, 387, 77, 92, 111, 160, 381/300, 301, 306, 307, 340, 342, 396, 381/431, 386, 98, 182, 339, 107; 367/138, 13, 153, 87; 73/584, 632; 600/443; 607/45; 601/2; 473/101
See application file for complete search history.

(56) References Cited

U.S. PATENT DOCUMENTS 4,148,481 A * 4/1979 Smith-Vaniz ..... A63D 5/04 377/5
4,648,079 A * 3/1987 Stedtnitz ..... G01V 13/00 367/13
4,885,782 A * 12/1989 Eberbach ..... H04R 3/14 181/144
4,888,804 A * 12/1989 Gefvert ..... H04R 5/02 381/304
5,233,664 A * 8/1993 Yanagawa ..... H04R 1/403 381/182
5,889,876 A * 3/1999 Billings ..... H04R 1/345 181/144
6,128,395 A * 10/2000 De Vries ..... H04R 1/403 381/182
6,508,774 B1 * 1/2003 Acker ..... A61N 7/02 600/439
7,116,790 B2 * 10/2006 Heron et al. ..... 381/59
7,319,641 B2 * 1/2008 Goudie ..... H04R 1/403 367/138

(Continued)

*Primary Examiner* — Gerald Gauthier
(74) *Attorney, Agent, or Firm* — Blakely, Sokoloff, Taylor & Zafman LLP

(57) ABSTRACT

A protection management unit is described that detects one or more poor performing transducers in a loudspeaker array. Upon detection of one or more poor performing transducers, the protection management unit adjusts driving signals for neighboring transducers to compensate for the reduced capabilities of the poor performing transducers. By adjusting driving signals to neighboring transducers, the protection management unit ensures that a desired tone and spatial response for sound emitted by the loudspeaker array is maintained despite one or more poor performing transducers. Other embodiments are also described.

50 Claims, 6 Drawing Sheets

(56) References Cited

U.S. PATENT DOCUMENTS 7,324,851 B1 * 1/2008 DiLorenzo ..... A61N 1/3605 607/45
7,450,474 B2 * 11/2008 Klein ..... H04R 29/002 367/13
7,557,728 B1 * 7/2009 Bicheno et al. ..... 340/691.3
7,590,257 B1 * 9/2009 Blanchard ..... H04R 1/345 381/339
7,881,489 B2 * 2/2011 Matsuzawa ..... B06B 1/0292 381/171
7,907,740 B2 * 3/2011 Matsuzawa ..... H04R 1/403 381/111
8,000,481 B2 * 8/2011 Nishikawa ..... G10K 11/341 381/111
8,041,049 B2 * 10/2011 Yoshino ..... H04S 7/302 381/77
8,054,989 B2 11/2011 Paik
8,144,900 B2 * 3/2012 Oxford ..... H04R 1/403 181/145
8,160,268 B2 * 4/2012 Horbach ..... 381/89
8,184,835 B2 * 5/2012 Goodwin ..... H04R 1/40 381/182
8,311,261 B2 * 11/2012 Graber ..... H04R 1/403 381/182
8,437,485 B2 * 5/2013 Kuhn-Rahloff ..... H04S 7/30 381/300
8,494,203 B2 * 7/2013 Rodman et al. ..... 381/345
8,520,887 B2 * 8/2013 Simidian, II ..... H04R 9/047 381/408
8,638,959 B1 * 1/2014 Hall ..... H04S 3/008 381/160
8,693,699 B2 * 4/2014 Fellers et al. ..... 381/71.1
8,837,743 B2 * 9/2014 Aarts et al. ..... 381/17
8,934,655 B2 * 1/2015 Breen ..... H04R 1/403 381/160
8,995,697 B2 * 3/2015 Gladwin et al. ..... 381/304
9,008,335 B2 * 4/2015 Choi ..... H04R 1/288 381/160
9,042,561 B2 * 5/2015 Gautama ..... 381/55
9,119,012 B2 * 8/2015 Ikizyan ..... H04R 3/00
2003/0059056 A1 * 3/2003 Griniasty ..... H04R 29/001 381/59
2003/0185404 A1 * 10/2003 Milsap ..... H04R 3/12 381/77
2004/0091120 A1 * 5/2004 Kantor et al. ..... 381/61
2007/0034010 A1 * 2/2007 Langlois ..... G01N 29/0609 73/584
2008/0165979 A1 * 7/2008 Takumai ..... H04R 1/403 381/59
2008/0253229 A1 * 10/2008 Liu ..... G01N 29/041 367/87
2009/0087000 A1 * 4/2009 Ko ..... H04R 1/403 381/182
2009/0214067 A1 * 8/2009 Bothe ..... H04R 1/345 381/339
2010/0278356 A1 * 11/2010 Hersbach ..... H04R 3/02 381/98
2010/0290643 A1 11/2010 Mihelich et al.
2011/0216926 A1 * 9/2011 Riggs ..... H04R 5/02 381/300
2012/0177224 A1 * 7/2012 Veneri et al. ..... 381/103
2012/0195447 A1 8/2012 Hiruma et al.
2012/0250912 A1 * 10/2012 Chung ..... H04R 27/00 381/306
2013/0259238 A1 * 10/2013 Xiang ..... G06F 3/017 381/17
2013/0322439 A1 * 12/2013 Verhallen et al. ..... 370/389
2015/0010170 A1 * 1/2015 Lindahl et al. ..... 381/119
2015/0015426 A1 * 1/2015 Lindahl et al. ..... 341/53

* cited by examiner

LOUDSPEAKER ARRAY PROTECTION MANAGEMENT

RELATED MATTERS

This application claims the benefit of the earlier filing date of U.S. provisional application No. 61/784,944, filed Mar. 14, 2013.

FIELD

A system and method for monitoring transducers in a loudspeaker array and adjusting driving signals to each transducer to protect each transducer while maintaining tone and spatial response for sound produced by the array is described. Other embodiments are also described.

BACKGROUND

Loudspeaker arrays may be comprised of multiple transducers for outputting sound. An audio receiver or other audio device may drive each transducer with separate signals for producing a particular beam/polar pattern. For example, filtered versions of an audio signal may be used to drive each transducer in the loudspeaker array to achieve a wide or narrow beam pattern. Driving each transducer to produce a desired sound pattern relies on the assumption that each transducer is properly operating within a set of prescribed tolerances. Failure to achieve these operating tolerances for one or more of the transducers results in the tone and spatial response of sound produced by the loudspeaker array being inaccurate or distorted.

BRIEF DESCRIPTION OF THE DRAWINGS

The embodiments of the invention are illustrated by way of example and not by way of limitation in the figures of the accompanying drawings in which like references indicate similar elements. It should be noted that references to "an" or "one" embodiment of the invention in this disclosure are not necessarily to the same embodiment, and they mean at least one.

DETAILED DESCRIPTION

Several embodiments are described with reference to the appended drawings are now explained. While numerous details are set forth, it is understood that some embodiments of the invention may be practiced without these details. In other instances, well-known circuits, structures, and techniques have not been shown in detail so as not to obscure the understanding of this description.

Figure 1:
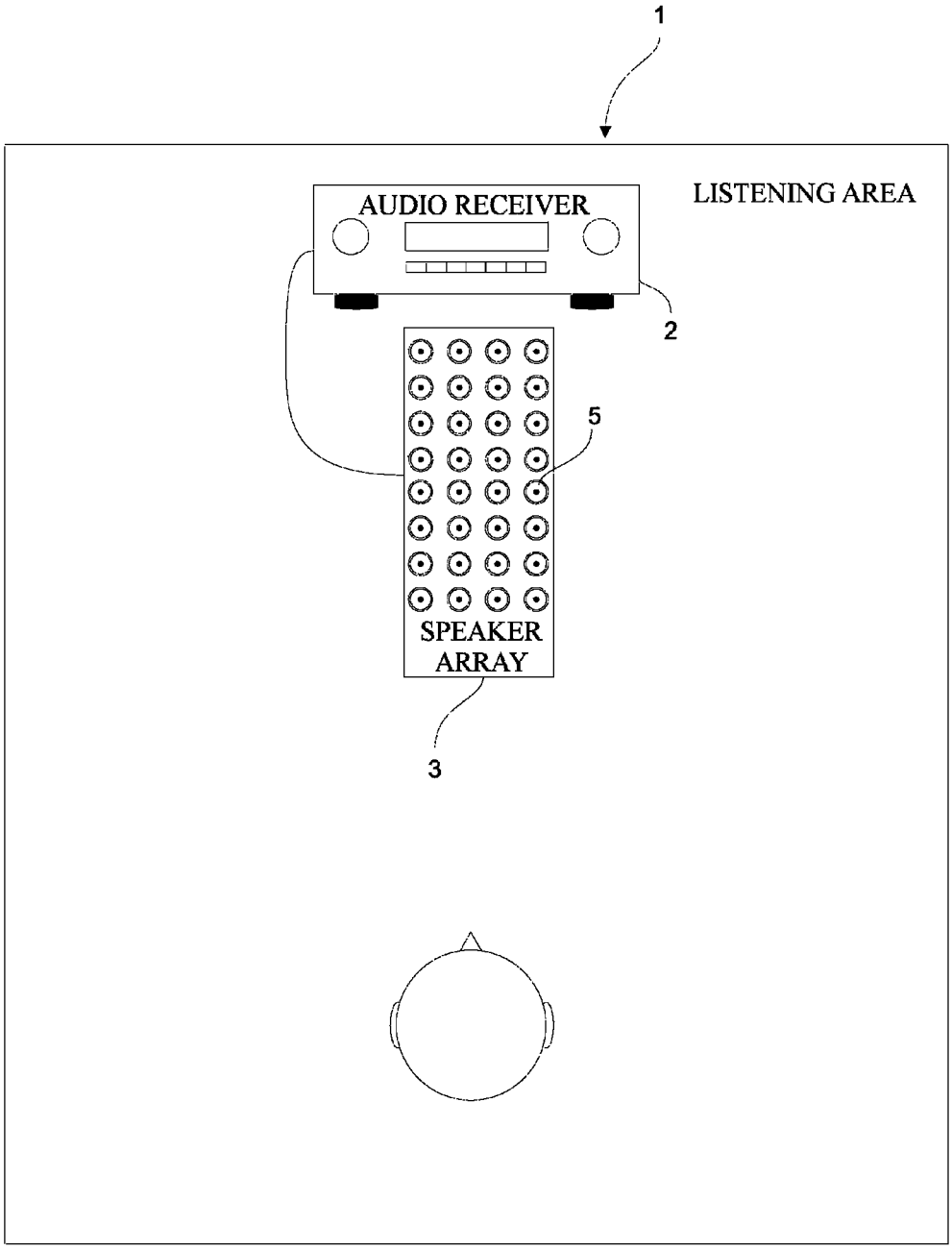
FIG. 1 shows a view of a listening area with an audio receiver and a loudspeaker array according to one embodiment.

FIG. 1 shows a view of a listening area 1 with an audio receiver 2 and a loudspeaker array 3. The audio receiver 2 may be coupled to the loudspeaker array 3 to drive individual transducers 5 in the loudspeaker array 3 to emit various sound/beam/polar patterns into the listening area 1. The audio receiver 2 may adjust driving signals provided to each transducer 5 based on monitored performance of each transducer 5 to maintain tone and spatial response of the loudspeaker array 3 while ensuring protection of each transducer 5 as will be described in further detail below.

Although shown with a single loudspeaker array 3, in other embodiments multiple loudspeaker arrays 3 may be coupled to the audio receiver 2. For example, three loudspeaker arrays 3 may be positioned in the listening area 1 to respectively represent front left, front right, and front center audio channels of a piece of sound program content (e.g., a musical composition or an audio track for a movie) output by the audio receiver 2.

As shown in FIG. 1, the loudspeaker array 3 may include wires or conduit for connecting to the audio receiver 2. For example, each loudspeaker array 3 may include multiple wiring points and the audio receiver 2 may include complementary wiring points. The wiring points may be binding posts or spring clips on the back of the loudspeaker array 3 and the audio receiver 2, respectively. The wires are separately wrapped around or are otherwise coupled to respective wiring points to electrically couple the loud loudspeaker array 3 to the audio receiver 2.

In other embodiments, the loudspeaker array 3 may be coupled to the audio receiver 2 using wireless protocols such that the array 3 and the audio receiver 2 are not physically joined but maintain a radio-frequency connection. For example, the loudspeaker array 3 may include a WiFi receiver for receiving audio signals from a corresponding WiFi transmitter in the audio receiver 2. In some embodiments, the loudspeaker array 3 may include integrated amplifiers for driving the transducers 5 using the wireless audio signals received from the audio receiver 2. The loudspeaker array 3 may be a standalone unit that includes components for signal processing and for driving each transducer 5 according to the techniques described below.

Figure 2A:
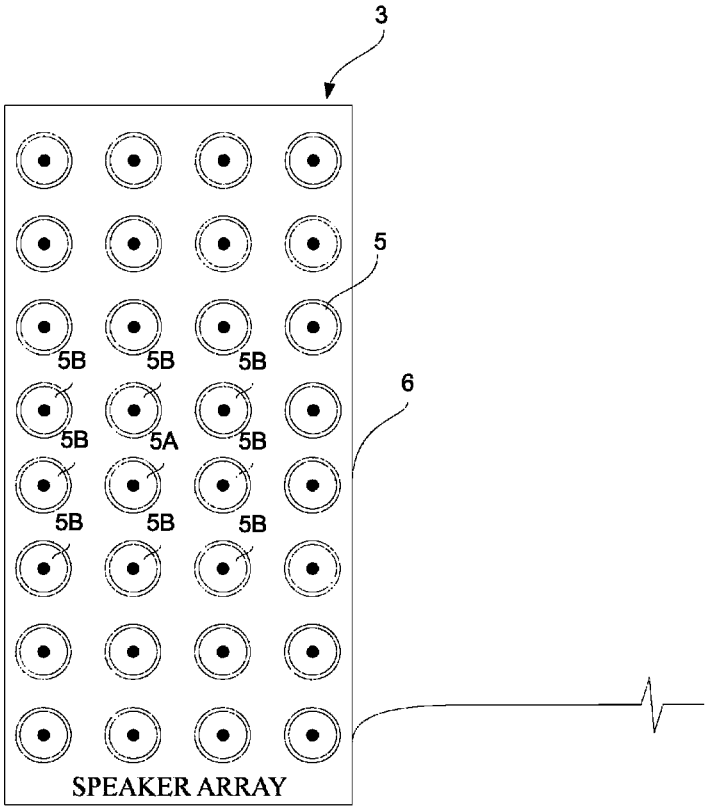
FIG. 2A shows one loudspeaker array with multiple transducers housed in a single cabinet according to one embodiment.
Figure 2B:
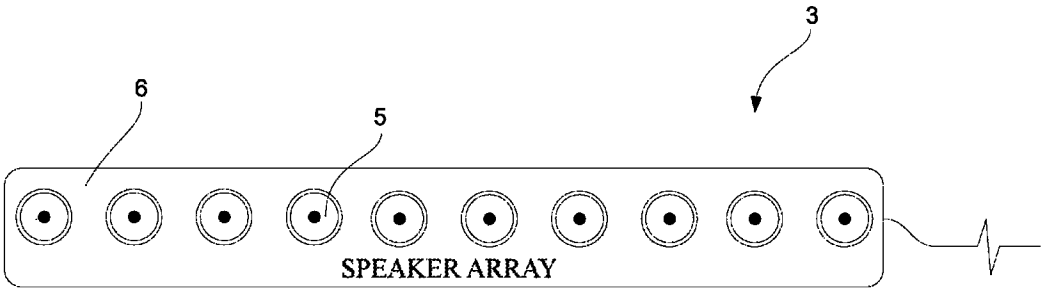
FIG. 2B shows another loudspeaker array with multiple transducers housed in a single cabinet according to another embodiment.

FIG. 2A shows one loudspeaker array 3 with multiple transducers 5 housed in a single cabinet 6. In this example, the loudspeaker array 3 has thirty-two distinct transducers 5 evenly aligned in eight rows and four columns within the cabinet 6. In other embodiments, different numbers of transducers 5 may be used with uniform or non-uniform spacing. For instance, as shown in FIG. 2B, ten transducers 5 may be aligned in a single row in the cabinet 6 to form a sound-bar style loudspeaker array 3. Although shown as aligned in a flat plane or straight line, the transducers 5 may be aligned in a curved fashion along an arc.

The transducers 5 may be any combination of full-range drivers, mid-range drivers, subwoofers, woofers, and tweeters. Each of the transducers 5 may use a lightweight diaphragm, or cone, connected to a rigid basket, or frame, via a flexible suspension that constrains a coil of wire (e.g., a voice coil) to move axially through a cylindrical magnetic gap. When an electrical audio signal is applied to the voice coil, a magnetic field is created by the electric current in the voice coil, making it a variable electromagnet. The coil and the transducer 5's magnetic system interact, generating a mechanical force that causes the coil (and thus, the attached cone) to move back and forth, thereby reproducing sound under the control of the applied electrical audio signal coming from a source (e.g., a signal processor, a computer, and the audio receiver 2).

Figure 3:
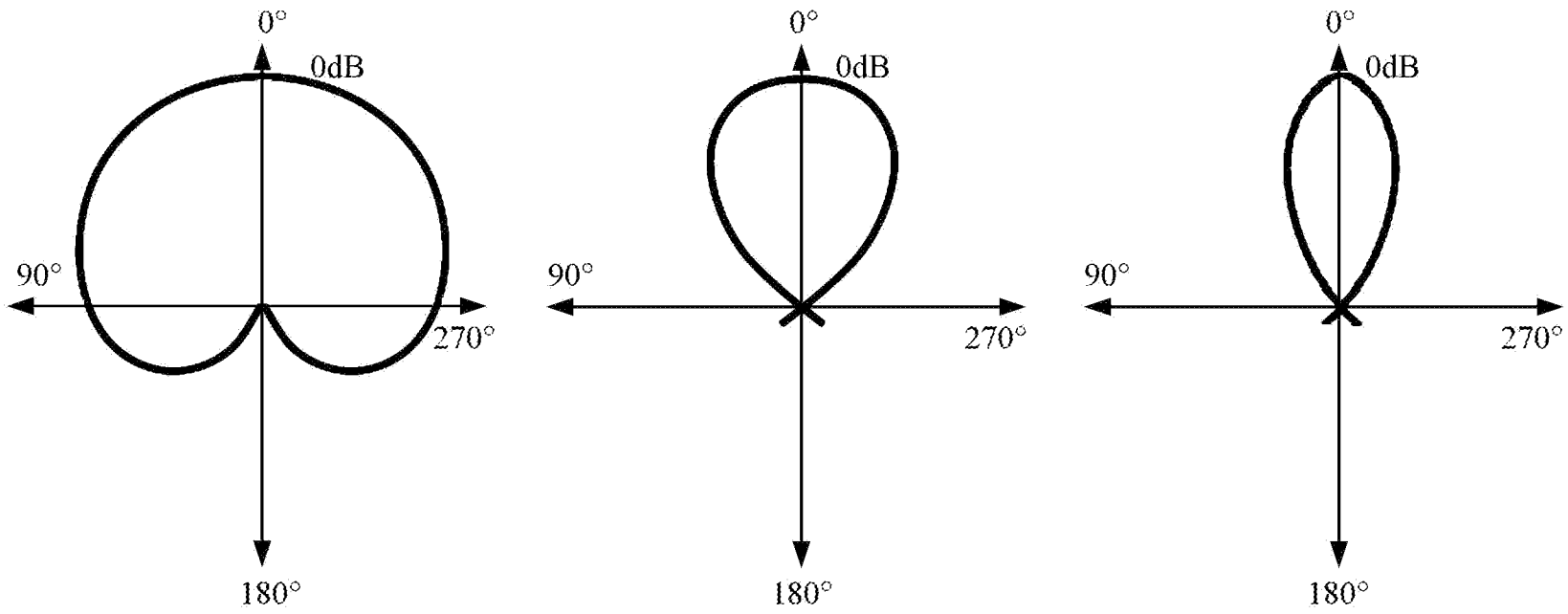
FIG. 3 shows three example polar patterns with varied directivity indexes.

Each transducer 5 may be individually and separately driven to produce sound in response to separate and discrete audio signals. By allowing the transducers 5 in the loudspeaker array 3 to be individually and separately driven according to different parameters and settings (including delays, frequencies, phases, and energy levels), the loudspeaker array 3 may produce numerous sound/beam/polar patterns to simulate or better represent respective channels of sound program content played to a listener. For example, beam patterns with different directivity indexes (DI) may be emitted by the loudspeaker array 3. FIG. 3 shows three example polar patterns with varied DIs (higher DI from left-to-right). The DIs may be represented in decibels or in a linear fashion (e.g., 1, 2, 3, etc.).

As noted above, the loudspeaker array 3 emits sound into the listening area 1. The listening area 1 is a location in which the loudspeaker array 3 is located and in which a listener is positioned to listen to sound emitted by the loudspeaker array 3. For example, the listening area 1 may be a room within a house or commercial establishment or an outdoor area (e.g., an amphitheater).

Figure 4:
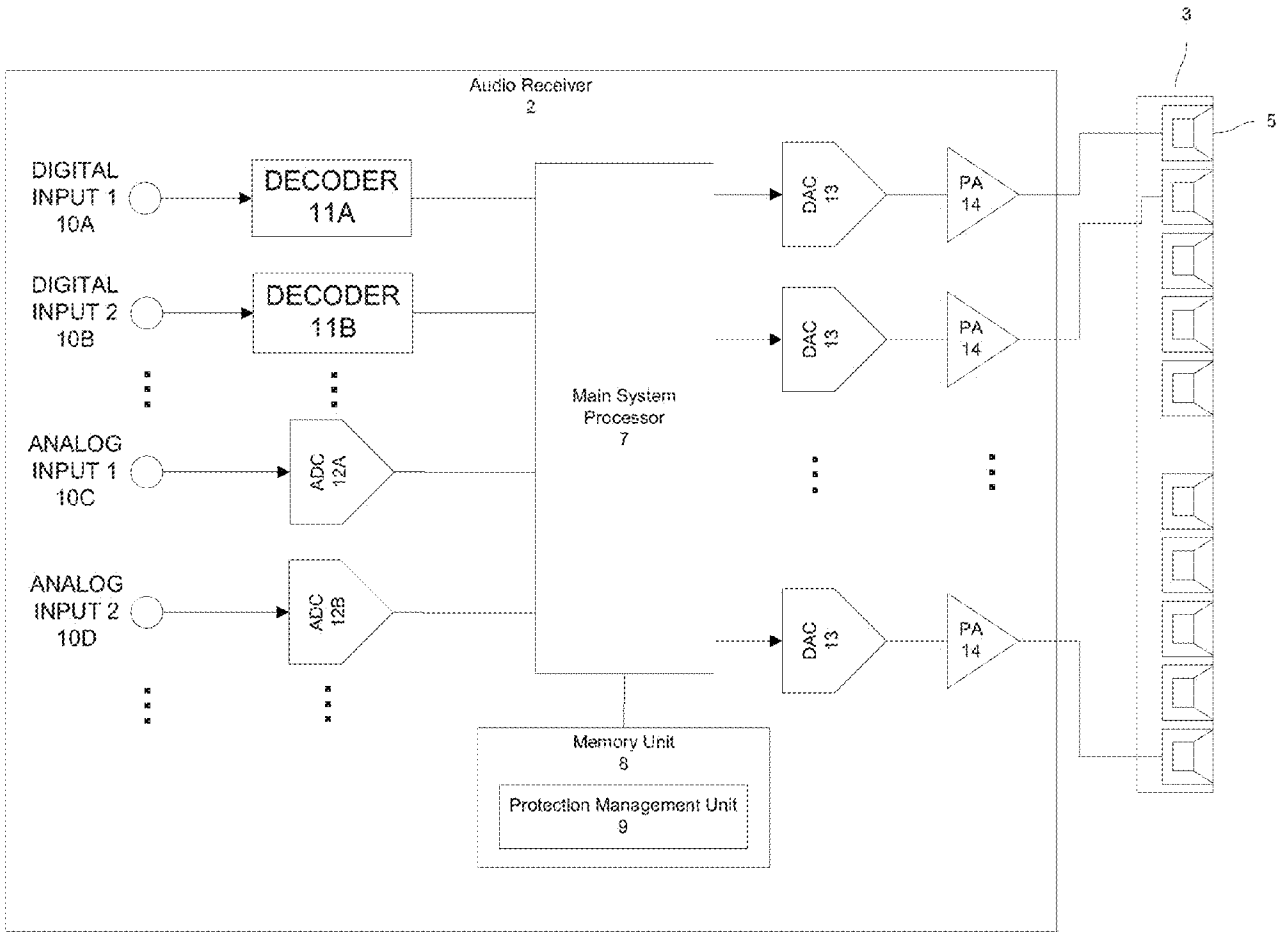
FIG. 4 shows a functional unit block diagram and some constituent hardware components of the audio receiver according to one embodiment.

FIG. 4 shows a functional unit block diagram and some constituent hardware components of the audio receiver 2 according to one embodiment. Although shown as separate, in one embodiment the audio receiver 2 is integrated within the loudspeaker array 3. The components shown in FIG. 4 are representative of elements included in the audio receiver 2 and should not be construed as precluding other components. The audio receiver 2 may be any electronic device capable of processing audio signals, including a desktop computer, a laptop computer, a tablet computer, a mobile phone, and a television. Each element of the audio receiver 2 will be described by way of example below.

The audio receiver 2 may include a main system processor 7 and a memory unit 8. The processor 7 and the memory unit 8 are generically used here to refer to any suitable combination of programmable data processing components and data storage that conduct the operations needed to implement the various functions and operations of the audio receiver 2. The processor 7 may be a special purpose processor such as application-specific integrated circuits (ASICs), a general purpose microprocessor, a field-programmable gate array (FPGA), a digital signal controller, or a set of hardware logic structures (e.g., filters, arithmetic logic units, and dedicated state machines) while the memory unit 8 may refer to microelectronic, non-volatile random access memory. An operating system may be stored in the memory unit 8, along with application programs specific to the various functions of the audio receiver 2, which are to be run or executed by the processor 7 to perform the various functions of the audio receiver 2. For example, the audio receiver 2 may include a protection management unit 9, which in conjunction with other hardware elements of the audio receiver 2, maintains tone and spatial response for sound produced by the loudspeaker array 3 while ensuring protection of each transducer 5 (i.e., preventing damage or destruction to a transducer 5 caused by an intense and/or a powerful driving signal). Although described as software residing in the memory unit 8, the protection management unit 9 may be implemented as one or more hardware logic structures incorporated within the audio receiver 2.

The audio receiver 2 may include multiple inputs 10 for receiving sound program content using electrical, radio, or optical signals from an external device. The inputs 10 may be a set of digital inputs 10A and 10B and analog inputs 10C and 10D including a set of physical connectors located on an exposed surface of the audio receiver 2. For example, the inputs 10 may include a High-Definition Multimedia Interface (HDMI) input, an optical digital input (Toslink), and a coaxial digital input. In one embodiment, the audio receiver 2 receives audio signals through a wireless connection with an external device. In this embodiment, the inputs 10 include a wireless adapter for communicating with an external device using wireless protocols. For example, the wireless adapter may be capable of communicating using Bluetooth, IEEE 802.11x, cellular Global System for Mobile Communications (GSM), cellular Code division multiple access (CDMA), or Long Term Evolution (LTE).

General signal flow from the inputs 10 will now be described. Looking first at the digital inputs 10A and 10B, upon receiving a digital audio signal through an input 10A or 10B, the audio receiver 2 uses a decoder 11A or 11B to decode the electrical, optical, or radio signals into a set of audio channels representing sound program content. For example, the decoder 11A may receive a single signal containing six audio channels (e.g., a 5.1 signal) and decode the signal into six audio channels. The decoders 11A and 11B may be capable of decoding an audio signal encoded using any codec or technique, including Advanced Audio Coding (AAC), MPEG Audio Layer II, and MPEG Audio Layer III.

Turning to the analog inputs 10C and 10D, each analog signal received by analog inputs 10C and 10D represents a single audio channel of the sound program content. Accordingly, multiple analog inputs 10C and 10D may be needed to receive each channel of sound program content. The audio channels may be digitized by respective analog-to-digital converters 12A and 12B to form digital audio channels.

The processor 7 receives one or more digital, decoded audio signals from the decoder 11A, the decoder 11B, the analog-to-digital converter 12A, and/or the analog-to-digital converter 12B. The processor 7 in conjunction with the protection management unit 9 processes these signals to produce processed audio signals that maintain a constant desired tone and spatial response for sound produced by the loudspeaker array 3 while protecting each transducer 5 from intense and/or powerful driving signals as described in further detail below.

As shown in FIG. 4, the processed audio signals produced by the processor 7 are passed to one or more digital-to-analog converters 13 to produce one or more distinct analog signals. The analog signals produced by the digital-to-analog converters 13 are fed to the power amplifiers 14 to drive selected transducers 5 of the loudspeaker array 3 to produce corresponding beam patterns with a desired tone and spatial response.

Figure 5:
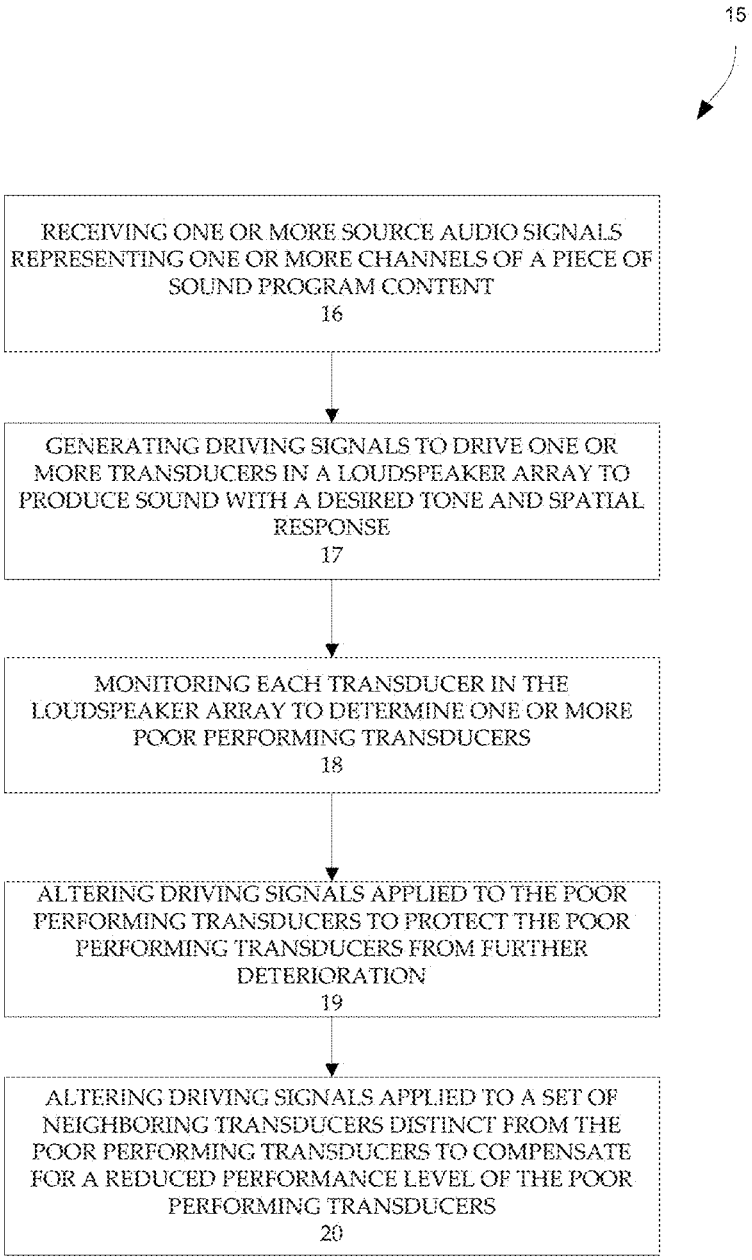
FIG. 5 shows a method for maintaining a constant desired tone and spatial response for sound produced by the loudspeaker array while protecting each poor performing transducer from further deterioration according to one embodiment.

FIG. 5 shows a method 15 for maintaining a constant desired tone and spatial response for sound produced by the loudspeaker array 3 while protecting each poor performing transducer 5 from further deterioration according to one embodiment. The method 15 may be performed by one or more components of the audio receiver 2, including the processor 7 and the protection management unit 9. In one embodiment, the method 15 is entirely performed within the loudspeaker array 3.

The method 15 begins with the receipt of one or more source audio signals representing one or more channels of a piece of sound program content at operation 16. For example, the method 15 may begin at operation 16 with the receipt of an audio signal representing the front right channel for a movie soundtrack from a computing device (e.g., a desktop computer). The one or more source audio signals may be received through inputs 10 and processed by corresponding decoders 11 or analog-to-digital converters 12 before being fed to the main system processor 7 and/or the protection management unit 9 for further processing. In some embodiment, the source audio signals are stored within the audio receiver 2 and operation 16 retrieves the signals from local memory.

At operation 17, the processor 7 generates driving signals to drive one or more of the transducers 5 to produce one or more directivity patterns with desired tones and spatial responses. For example, the processor 7 may generate a directivity pattern similar to one or more of the directivity patterns shown in FIG. 3. Operation 17 further drives the one or more of the transducers 5 based on the generated driving signals using the digital-to-analog converters 13 and the power amplifiers 14 within the audio receiver 2.

At operation 18, the protection management unit 9 monitors each of the transducers 5 in the loudspeaker array 3 to (1) determine performance characteristics for each of the transducers 5 and (2) discover one or more poor performing transducers 5 in the array 3. Monitoring of the transducers 5 may be performed by examining the current and voltages sent from each transducer 5's power amplifier 14 in response to driving the transducers 5 at operation 17. The current and voltage settings may indicate that one or more transducers 5 are operating poorly (e.g., operating below a prescribed tolerance) and/or one or more transducers 5 are inoperative based on known models of the transducers 5. These current and voltage readings may be compared along with displacement measurements obtained from one or more sensors that are placed on or near each transducer 5 to measure the level of movement of each transducer 5 in response to known driving signals. The measured level of movement of each transducer 5 may be used to characterize the performance of each transducer and to determine one or more poor performing or inoperable transducers 5. Readings from each of the systems described above may be categorized based on one or more frequency bands (e.g., based on low and high band content) to determine the performance of the transducers 5 with respect to frequency. Poor performance or inoperability of one or more transducers 5 may be the result of (1) deterioration of the transducers 5 over time; (2) defects during manufacturing of the transducers 5 and/or the loudspeaker array 3; and/or (3) driving the transducers 5 with excessive low-frequency or high amplitude signals.

Based on a determination at operation 18 that one or more transducers 5 are operating below a prescribed tolerance and/or one or more transducers 5 are inoperative, operation 19 applies protection to the poor performing transducers 5. In one embodiment, protection may include reducing the amplitude, reducing the frequency range, altering the phase, and/or changing other characteristics of driving signals used to drive the poor performing transducers 5. For example, operation 19 may high-pass filter driving signals used to drive the poor performing transducers 5 to reduce the amount of low-frequency content used to drive the poor performing transducers 5. In one embodiment, operation 20 turns the poor performing transducers 5 off or to an inactive state such that these transducers 5 no longer emit sound. Since the poor performing transducers 5 are no longer operating or are operating below their expected abilities (e.g., reduced frequency content), the tone and spatial response of sound produced at operation 17 may be distorted from a desired tone and spatial response. For example, the directivity index of a desired spatial pattern may be altered; the overall tone of sound emitted by the loudspeaker array 3 may be altered (e.g., reduced low-frequency content); the direction of a corresponding directivity pattern may be shifted; or other similar distortions.

Based on the protection applied at operation 19, operation 20 compensates for these distortions caused by the poor performing transducers 5. In one embodiment, operation 20 alters signals to other transducers 5 neighboring or surrounding the poor performing transducers 5 to compensate for distortions caused by the protection applied at operation 19. In one embodiment, neighboring transducers 5 are transducers 5 that are immediately adjacent to a poor performing transducer 5. For example, in the loudspeaker array 3 shown in FIG. 2A, the transducers 5B are immediate neighbors to the transducer 5B. In another embodiment, neighboring transducers 5 may be separated by one or more other transducers 5.

In one embodiment, operation 20 modifies signals to neighboring transducers 5 to increase the frequencies covered by these neighboring transducers. For example, driving signals for one or more poor performing transducers 5 may have been adjusted at operation 19 to remove low-band frequencies (e.g., eliminate frequencies below 150 Hz or another cutoff). This frequency reduction to the poor performing transducers 5 may reduce the probability that these transducers 5 are blown out or are further deteriorated; however, the tone and spatial response for sounds emitted by the loudspeaker array 3 would be altered based on this changed frequency response. For example, the protection applied at operation 19 may cause less bass to be emitted at one end of the loudspeaker array 3. To compensate for this tone and possible spatial response change, operation 20 increases the low-band sound emitted by transducers 5 neighboring the poor performing transducers 5. This compensation increases low-frequency content produced by the loudspeaker array 3, which was lost when protection was applied at operation 19, and attainment of a desired tone and spatial response. In other embodiments, other properties of driving signals may be altered at operation 20, including delays, phases, and energy levels. For example, the amplitude of a frequency band for the neighboring transducers 5B may be adjusted to compensate for a reduction of frequency coverage or amplitude for the poor performing transducer 5A.

By compensating for protection applied to poor performing transducers 5, the method 15 ensures that a desired tone and spatial response for sound emitted by the loudspeaker array 3 is maintained without allowing further deterioration or destruction of the poor performing transducers 5 to occur. As noted above, in one embodiment, the method 15 is entirely performed within the loudspeaker array 3. In this embodiment, one or more components of the audio receiver 2 may be incorporated within the loudspeaker array 3.

As explained above, an embodiment of the invention may be an article of manufacture in which a machine-readable medium (such as microelectronic memory) has stored thereon instructions which program one or more data processing components (generically referred to here as a "processor") to perform the operations described above. In other embodiments, some of these operations might be performed by specific hardware components that contain hardwired logic (e.g., dedicated digital filter blocks and state machines). Those operations might alternatively be performed by any combination of programmed data processing components and fixed hardwired circuit components.

While certain embodiments have been described and shown in the accompanying drawings, it is to be understood that such embodiments are merely illustrative of and not restrictive on the broad invention, and that the invention is not limited to the specific constructions and arrangements shown and described, since various other modifications may occur to those of ordinary skill in the art. The description is thus to be regarded as illustrative instead of limiting.

What is claimed is:

1. A method by an audio receiver for compensating for poor performing transducers in a loudspeaker array, the audio receiver having one or more inputs, the method comprising:

receiving at each input one or more source audio signals representing one or more channels of a piece of sound program content;

monitoring by a protection management unit each transducer in the loudspeaker array to determine an inoperative transducer while the transducers are driven based on the audio signals; and altering by a main system processor driving signals applied to transducers neighboring the inoperative transducer to compensate for a lack of output from the inoperative transducer.

2. The method of claim 1, wherein monitoring each transducer in the loudspeaker array, comprises:

modeling each transducer based on current and voltages sent from power amplifiers associated with each transducer; and comparing the current and voltages of driving signals sent from the power amplifiers to each transducer with the modeled current and voltages sent from power amplifiers associated with each transducer to determine the inoperative transducer.

3. The method of claim 1, further comprising:

altering driving signals applied to the inoperative transducer to reduce potential damage to the inoperative transducer.

4. The method of claim 3, wherein altering the driving signals applied to the inoperative transducer, comprises:

high-pass filtering the driving signals applied to the inoperative transducer to remove low-frequency content below a cutoff frequency.

5. The method of claim 4, wherein altering the driving signals applied to the neighboring transducers to compensate for the lack of output from the inoperative transducer, comprises:

increasing low-frequency content in the driving signals applied to the neighboring transducers.

6. The method of claim 4, wherein altering the driving signals applied to the neighboring transducers to compensate for the lack of output from the inoperative transducer, comprises:

increasing the energy level of one or more frequency bands in the driving signals applied to the neighboring transducers.

7. The method of claim 1, wherein the neighboring transducers are transducers immediately adjacent to the inoperative transducer in the loudspeaker array.

8. A computing device for compensating for poor performing transducers in a loudspeaker array, comprising:

one or more inputs for receiving one or more source audio signals representing one or more channels of a piece of sound program content;

a hardware processor; and a memory unit for storing instructions, which when executed by the hardware processor:

monitor each transducer in the loudspeaker array to determine a poor performing transducer by examining the current and voltages of driving signals sent from power amplifiers to each transducer while the transducers are driven based on the audio signals, and alter the driving signals applied to transducers neighboring the poor performing transducer to compensate for a reduced performance level of the poor performing transducer.

9. The computing device of claim 8, wherein the poor performing transducer is a transducer in the loudspeaker array that is operating below a prescribed tolerance.

10. The computing device of claim 8, wherein the memory unit includes further instructions, which when executed by the hardware processor:

model each transducer based on current and voltages sent from power amplifiers associated with each transducer; and compare the current and voltages of driving signals sent from the power amplifiers to each transducer with the modeled current and voltages sent from power amplifiers associated with each transducer to determine the poor performing transducer.

11. The computing device of claim 8, wherein the memory unit includes further instructions, which when executed by the hardware processor:

alter driving signals applied to the poor performing transducer to reduce potential damage to the poor performing transducer.

12. The computing device of claim 11, wherein the memory unit includes further instructions, which when executed by the hardware processor:

high-pass filter the driving signals applied to the poor performing transducer to remove low-frequency content below a cutoff frequency.

13. The computing device of claim 12, wherein the memory unit includes further instructions, which when executed by the hardware processor:

increase low-frequency content in the driving signals applied to the neighboring transducers to compensate for the low-frequency content removed from the driving signals applied to the poor performing transducer.

14. The computing device of claim 13, wherein the memory unit includes further instructions, which when executed by the hardware processor:

increase the energy level of one or more frequency bands in the driving signals applied to the neighboring transducers to compensate for the low-frequency content removed from the driving signals applied to the poor performing transducer.

15. The computing device of claim 8, wherein the neighboring transducers are transducers immediately adjacent to the poor performing transducer in the loudspeaker array.

16. An article of manufacture for compensating for poor performing transducers in a loudspeaker array, comprising:

a non-transitory machine-readable storage medium that stores instructions which, when executed by a processor in a computer, monitor each transducer in the loudspeaker array to determine a an inoperative transducer, and alter driving signals applied to transducers neighboring the inoperative transducer to compensate for a lack of output from the inoperative transducer.

17. The article of manufacture of claim 16, wherein the non-transitory machine-readable storage medium stores further instructions which, when executed by the processor:

model each transducer based on current and voltages sent from power amplifiers associated with each transducer; and compare the current and voltages of driving signals sent from the power amplifiers to each transducer with the modeled current and voltages sent from power amplifiers associated with each transducer to determine the inoperative transducer.

18. The article of manufacture of claim 16, wherein the non-transitory machine-readable storage medium stores further instructions which, when executed by the processor:

alter driving signals applied to the inoperative transducer to reduce potential damage to the inoperative transducer.

19. The article of manufacture of claim 18, wherein the non-transitory machine-readable storage medium stores further instructions which, when executed by the processor:

high-pass filter the driving signals applied to the inoperative transducer to remove low-frequency content below a cutoff frequency.

20. The article of manufacture of claim 19, wherein the non-transitory machine-readable storage medium stores further instructions which, when executed by the processor:

increase low-frequency content in the driving signals applied to the neighboring transducers.

21. The article of manufacture of claim 19, wherein the non-transitory machine-readable storage medium stores further instructions which, when executed by the processor:

increase the energy level of one or more frequency bands in the driving signals applied to the neighboring transducers.

22. The article of manufacture of claim 16, wherein the neighboring transducers are transducers immediately adjacent to the inoperative transducer in the loudspeaker array.

23. A method for adjusting audio emitted by a speaker array, comprising:

playing audio content through a plurality of transducers in the speaker array to produce a desired tone and spatial response;

detecting a transducer in the speaker array performing below a predefined threshold;

reducing frequency content applied to the detected transducer;

compensating for the detected transducer by adjusting frequency content applied to the remaining transducers in the speaker array to maintain the desired tone and spatial response for the audio content.

24. The method as in claim 23 wherein the frequency content is reduced to prevent potential damage to the detected transducer.

25. The method as in claim 23 wherein the remaining transducers are adjacent to the detected transducer and wherein the compensating comprises increasing the energy level of one or more frequency bands in the driving signals applied to the remaining transducers.

26. The method as in claim 25 wherein the detecting comprises comparing current or voltage of driving signals sent from one or more power amplifiers to each transducer with modelled current or voltage sent from one or more amplifiers.

27. A receiver apparatus comprising:

a processing system;

one or more amplifiers coupled to the processing system, the one or more amplifiers having outputs, each of which is coupled to a transducer in a speaker array, the processing system configured to play audio content through a plurality of transducers in the speaker array to produce a desired tone and spatial response, and to detect a poor performing transducer in the speaker array performing below a predefined threshold and to reduce content in a frequency band applied to the poor performing transducer that is performing below the predefined threshold and to compensate for the reduction by adjusting content in the frequency band applied to the remaining transducers in the speaker array to maintain the desired tone and spatial response for the audio content.

28. The receiver as in claim 27 wherein the content is reduced to prevent potential damage to the poor performing transducer.

29. The receiver as in claim 27 wherein the processing system detects the poor performing transducer by comparing current or voltage applied to the poor performing transducer to modelled current or voltage.

30. A receiver apparatus comprising:

a processing system;

a set of amplifiers coupled to the processing system, the set of amplifiers having outputs, each of which is coupled to a transducer in a speaker array, the processing system configured to play audio content through a plurality of transducers in the speaker array to produce a desired tone and spatial response, and to detect a poor performing transducer in the speaker array performing below a predefined threshold and to reduce content in a frequency band applied to the poor performing transducer that is performing below the predefined threshold and to compensate for the reduction by adjusting content in the frequency band applied to the remaining transducers in the speaker array to maintain the desired tone and spatial response for the audio content.

31. The receiver as in claim 30 wherein the content is reduced to prevent potential damage to the poor performing transducer.

32. The receiver as in claim 30 wherein the processing system detects the poor performing transducer by comparing current or voltage applied to the poor performing transducer to modelled current or voltage.

33. The receiver as in claim 30 wherein each transducer in the speaker array is individually and separately driven by one amplifier in the set of amplifiers.

34. The receiver as in claim 30 wherein the remaining transducers are adjacent to the poor performing transducer.

35. The receiver as in claim 33 wherein the receiver comprises one or more inputs for receiving sound program content using electrical, radio or optical signals from an external device.

36. The receiver as in claim 35 wherein the one or more inputs include a wireless adapter for communicating with an external device using wireless protocols.

37. A receiver apparatus comprising:

a processing system;

one or more amplifiers coupled to the processing system, the one or more amplifiers having outputs, each of which is configured to drive a transducer in a speaker array, the processing system configured to play audio content through a plurality of transducers in the speaker array to produce a desired tone and spatial response, and to detect a poor performing transducer in the speaker array performing below a predefined threshold and to reduce content in a frequency band applied to the poor performing transducer that is performing below the predefined threshold and to compensate for the reduction by adjusting content in the frequency band applied to the remaining transducers in the speaker array to maintain the desired tone and spatial response for the audio content.

38. The receiver as in claim 37 wherein the content is reduced to prevent potential damage to the poor performing transducer.

39. The receiver as in claim 37 wherein the processing system detects the poor performing transducer by comparing current or voltage applied to the poor performing transducer to modelled current or voltage.

40. The receiver as in claim 37 wherein each transducer in the speaker array is individually and separately driven by one amplifier in the one or more amplifiers.

41. The receiver as in claim 37 wherein the remaining transducers are adjacent to the poor performing transducer.

42. The receiver as in claim 37 wherein the receiver comprises one or more inputs for receiving sound program content using electrical, radio or optical signals from an external device.

43. The receiver as in claim 42 wherein the one or more inputs include a wireless adapter for communicating with an external device using wireless protocols.

44. A receiver apparatus comprising:

a processing system;

one or more amplifiers coupled to the processing system, the one or more amplifiers having outputs, each of which is configured to drive a transducer in a speaker array, the processing system configured to play audio content through a plurality of transducers in the speaker array to produce a desired tone and spatial response, and to detect a poor performing transducer in the speaker array performing below a predefined threshold and to adjust driving signals applied to the poor performing transducer that is performing below the predefined threshold and to compensate for the adjustment by adjusting driving signals applied to the one or more remaining transducers in the speaker array to compensate for the poor performing transducer.

45. The receiver as in claim 44 wherein the driving signal is adjusted to prevent potential damage to the poor performing transducer.

46. The receiver as in claim 44 wherein the processing system detects the poor performing transducer by comparing current or voltage applied to the poor performing transducer to modelled current or voltage.

47. The receiver as in claim 44 wherein each transducer in the speaker array is individually and separately driven by one amplifier in the one or more amplifiers.

48. The receiver as in claim 44 wherein the one or more remaining transducers are adjacent to the poor performing transducer.

49. The receiver as in claim 44 wherein the receiver comprises one or more inputs for receiving sound program content using electrical, radio or optical signals from an external device.

50. The receiver as in claim 49 wherein the one or more inputs include a wireless adapter for communicating with an external device using wireless protocols.

* * * * *